US005839419A

United States Patent [19]

Hawley

[11] Patent Number: 5,839,419

[45] Date of Patent: Nov. 24, 1998

[54] ADJUSTABLE AUTOMATIC THROTTLE ACTUATION CONTROLLER

[75] Inventor: Frank Hawley, La Verne, Calif.

[73] Assignee: Curtis E. Rodden, Titusville, Fla.

[21] Appl. No.: 671,207

[22] Filed: Jun. 27, 1996

[51] Int. Cl.[6] ..... F02D 11/08

[52] U.S. Cl. ..... 123/398; 123/342; 123/401

[58] Field of Search ..... 123/398, 396, 123/399, 400, 401, 342, 360

[56] References Cited

U.S. PATENT DOCUMENTS

| | | | |
|---|---|---|---|
| Re. 32,474 | 8/1987 | Reid | 307/10 |
| 2,840,064 | 6/1958 | Hofer | 123/97 |
| 3,517,653 | 6/1970 | Hajime et al. | 123/97 |
| 3,923,020 | 12/1975 | Gilligan | 123/103 |
| 4,286,685 | 9/1981 | Rudolph et al. | 180/176 |
| 4,362,138 | 12/1982 | Krueger et al. | 123/342 |
| 4,424,876 | 1/1984 | Filho | 180/175 |
| 4,462,372 | 7/1984 | Jackson | 123/452 |
| 4,467,219 | 8/1984 | Reid | 307/10 R |
| 4,493,303 | 1/1985 | Thompson et al. | 123/357 |
| 4,524,741 | 6/1985 | Corbi | 123/342 |
| 4,556,032 | 12/1985 | Miller | 123/438 |
| 4,574,752 | 3/1986 | Reichert, Jr. et al | 123/198 DB |
| 4,596,215 | 6/1986 | Palesotti | 123/335 |
| 4,784,099 | 11/1988 | Noe et al. | 123/398 |
| 4,812,671 | 3/1989 | Furrow | 307/10.1 |
| 4,840,157 | 6/1989 | Furrow | 123/352 |
| 4,873,891 | 10/1989 | Guanciale | 74/625 |
| 5,080,619 | 1/1992 | Uchida et al. | 440/84 |
| 5,200,900 | 4/1993 | Adrain et al. | 364/431.12 |
| 5,235,948 | 8/1993 | Grant et al. | 123/342 |
| 5,642,712 | 7/1997 | Biondo | 123/398 |

OTHER PUBLICATIONS

National Dragster, "Performance Industry News", National Hot Rod Assoc., May 24, 1985, p. 73.

National Dragster, "Dedenbear Products" (Ad.), National Hot Rod Assoc., May 24, 1985, p. 90.

National Dragster, "The New Solution" (Dedenbear Ad.) National Hot Rod Assoc., Jul. 5, 1985, p. 29.

National Dragster, "Race Car Products" (DRC Ad.), National Hot Rod Assoc., Aug. 23, 1985, p. 82.

National Dragster, "Performance Industry News", National Hot Rod Assoc., Aug. 30, 1985, p. 88.

National Dragster, "GT Throttle Stops" (Ad.), National Hot Rod Assoc., Oct. 4, 1985, p. 29.

National Dragster, "The Timing System Winning Professionals Depend On" (Dedenbear Ad), National Hot Rod Assoc., Dec. 13, 1985, p. 73.

National Dragster, "The Timing System Winning Professionals Depend On" (Dedenbear Ad), National Hot Rod Assoc., Jan. 24, 1986, p. 14.

National Dragster, "Race Car Products"(DRC Ad.), National Hot Rod Assoc., Feb. 7, 1986, p. 86.

National Dragster, "Introducing The 'Bear Stop' Throttle Stop" (Dedenbear Ad.), National Hot Rod Assoc., May 9, 1986, p. 29.

National Dragster, "Larry Reyes' Bullit, Inc." (Ad.), National Hot Rod Assoc., Jun. 6, 1986, p. 24.

National Dragster, "Control Yourself", National Hot Rod Assoc., Jun. 27, 1986, p. 94.

National Dragster, "Introducing The 'Bear Stop' Throttle Stop" (Dedenbear Ad.), National Hot Rod Assoc., Jul. 4, 1986, p. 27.

National Dragster, "Bullit Now Brings You More" (Ad.), National Hot Rod Assoc., Jul. 25, 1986, p. 48.

National Dragster, "The Solution" (Dedenbear Ad.), National Hot Rod Assoc., Aug. 29, 1986, p. 78.

National Dragster, "Starting Line Problems?" (Ad.–Bob's Pro Start), National Hot Rod Assoc., Sep. 26, 1986, p. 46.

National Dragster, "Dedenbear Products" (Ad.), National Hot Rod Assoc., Sep. 26, 1986, p. 105.

National Dragster, "In Drag Racing, Timing is Everything", National Hot Rod Assoc., May 20, 1988, pp. 18–21, 71.

National Dragster, "Stop Losing Races Due to Inconstancy", National Hot Rod Assoc., Apr. 27, 1990, pp. 23–25, 80.

Pro–Cube, "Installation and Operating Manual", K&R Performance Engineering, Inc., Jun. 1997.

Advertisement, "Our New Pro–Cube Delay Box", K&P Performance Engineering, Inc., (no date listed).

Advertisement, "K&R Performance Engineering", K&R Performance Engineering, Inc., (no date listed).

Catalog, "BRP Biondo Racing Products, Inc.", Biondo Racing Products, Inc., (no date listed).
Catalog and Technical Guide, "Dedenbear Products, Inc." Dedenbear Products, Inc. (no date listed).
Manual, "Installation and Operating Instructions For Transbrake and Throttle Stop Controller Model XTC–200 With Flinch Protection" K&R Performance Engineering, Inc., (no date listed).
Advertisement, "Digital Delay, Inc.", Digital Delay, Inc., (no date listed).

*Primary Examiner*—Willis R. Wolfe
*Assistant Examiner*—Hieu T. Vo
*Attorney, Agent, or Firm*—Brian S. Steinberger; Law Offices of Brian S. Steinberger

[57] ABSTRACT

An adjustable automatic starting line throttle actuation controller for use with a drag racing vehicle. The device controls the throttle from a preset partial throttle opening to a wide open throttle during the initial staging process of the race, while the driver holds the throttle in a wide open position. The device can control the opening of the carburetor linkage of the carburetor to a preset low r.p.m. at the starting line (during the staging process) before a race begins, and control the opening of the throttle for the first portion of the race after the race starts. A preferred version of the device has a dual piston cylinder having respective piston rods connected to the carburetor and one connected to the throttle pedal. An electronic activation assembly controls which piston rod is being actuated.

8 Claims, 2 Drawing Sheets

ADJUSTABLE AUTOMATIC THROTTLE ACTUATION CONTROLLER

BACKGROUND OF THE INVENTION

Cross-reference to Related Applications

This invention includes art that is included in a co-pending application Ser. No. 08/671,328 filed on Jun. 27, 1996 by the same inventor thereof titled Adjustable Automatic Starting Line Throttle Actuation Controller.

Field of the Invention

The present invention relates to an adjustable automatic throttle actuation controller for use with a drag race car using an internal combustion engine to control the opening of the carburetor linkage on the carburetor to maintain a preset low r.p.m. at the starting line before the start of a drag race while the driver is holding the throttle open while staging the drag race car and to control the opening of the throttle for the first portion of the race after the start of the race.

Prior Art

Prior art devices of this type have heretofore attempted to regulate the throttle after the start of a drag race. See for example U.S. Pat. Nos. 4,524,741 and 5,235,948.

U.S. Pat. No. 4,524,741 shows an adjustable device that can hold a predetermined r.p.m. and released on command.

U.S. Pat. No. 5,235,948 shows a throttle valve control system using a piston/cylinder assembly with a piston rod travel restricting assembly including a threaded travel rod mounted at one end to the piston rod, a stop plate on the cylinder, and a lock nut to restrict the movement of the piston rod, and a control valve.

Background of the Invention

In drag racing two cars line up at the starting line and leave when the start lights are activated on the starting line tree. The cars travel a fixed distance down a straight track, usually a quarter of a mile long, and the car which meets all the rules of the category being raced and reaches the finish line first wins.

A problem area occurs before the start of the race when drivers are staging their cars on the starting line. In drag racing drivers must bring their race car under control to the starting line until the front tires of the race car break a prestage infrared light beam and a stage infrared light beam so each infrared light beam turns on a set of amber light bulbs on the starting line tree to show the driver the car is properly staged at the starting line. This is difficult because there are a number of tasks the driver must perform while staging properly. In addition staging must be done quickly so the driver can have a second to mentally prepare for the start of the race before the starter turns on the lights that signal the start.

Most drivers who race with a full tree follow the same starting line procedure. They raise the engine r.p.m. slightly at pre stage, creep into the stage beam, stop, set the transmission brake button, open the throttle, wait for the tree to signal the start of the race, and release the transmission brake button when the tree is activated. Problems that drivers have when staging a drag race car with a pro tree include not getting the throttle fully applied and the engine to full r.p.m. before the start signal, the engine may stumble as the throttle is applied too quickly, and the driver may be inconsistent in starting reaction time because of the short time to open the throttle and get mentally ready to start the race.

Starting a race with a full tree is slightly different and many drivers do the following: pull into the stage beam, stop, set the transmission brake button, apply full throttle and hold the engine on the r.p.m. limiter, and release the transmission brake button on the top bulb when the tree is activated. The problems the driver has with this method is the engine may not come to a full r.p.m. smoothly when the throttle is applied and the driver has to hold the engine on full r.p.m. for a long time on the r.p.m. limiter. Sometimes drivers who are slow at staging are surprised by the tree being activated quickly before they are fully ready. Drivers may become concerned about this and rush during the staging process and lose their mental preparedness for the race. Drivers who don't have the throttle open when the tree is activated quickly may cause the engine to stumble when they open the throttle too quickly.

Accordingly, a heretofore unaddressed need exists for a throttle actuation controller that can control the amount, speed, and timing of the throttle opening at the starting line while staging the race car before the race and which can reduce the number of tasks that a driver has to perform to properly stage a drag race car.

There is no prior art that addresses the problems of controlling the throttle opening during the staging of a drag race car prior to the start of a race except the throttle pedal that controls the opening of the carburetor.

A second problem area occurs in certain categories of drag racing in which drivers must estimate prior to coming to the starting line the time that they will take to complete the race. The drivers must then complete the race in that time or slower in order to win, and they can lose if they complete the race in a faster time than they estimated. It is important, therefore, for drivers to control the engine r.p.m. and thereby the speed of their race cars during a race and throttle valve limiting devices have been used to achieve this.

Generally a system which includes a compressed gas controlled piston/cylinder device is installed between the throttle pedal and the carburetor linkage that controls the throttle valve. When the compressed gas is introduced to the cylinder it forces the piston rod to retract into the cylinder and when the throttle pedal is opened the throttle valve opens completely. After a predetermined amount of time from the start of the race a timer the system vents the compressed gas from the cylinder which releases the pressure and the piston rod extends from the cylinder causing the carburetor linkage to close the throttle valve. After a second predetermined amount of time the system activates the compressed gas system and introduces compressed gas into the cylinder forcing the piston rod to retract into the cylinder and opening the throttle valve completely. This is designed to limit the rate of acceleration of the race car, and not cause it to slow down, to achieve the estimated time to complete the race. This system caused problems including being difficult to control the degree of throttle valve closure when the flow of compressed gas was vented from the cylinder. To attempt to solve this problem some systems include an adjustment bolt screwed into the back of the cylinder which bolt was difficult to adjust. U.S. Pat. No. 5,235,948 attempted to solve these problems by creating a system to control the degree of throttle closure with a adjustment mechanism that limits the extension of the piston rod from the cylinder at selective points. The system also includes a gas flow controller between the source of compressed gas and the cylinder to limit the rate of gas flow into the cylinder. This is to control tire spin which occurs when the throttle valve reopens too quickly.

This system in U.S. Pat. No. 5,235,948 creates other problems which the present invention resolves. There is a limited space in the area of a race car engine where a throttle stop is attached. The space is restricted by the engine scoop, lines, intake manifold, and other items. The said system is big and wide. It is difficult to adjust in this limited space because it requires the use of two large wrenches to break apart the pair of lock nuts which are in close proximity to other engine parts and without room to easily access the lock nuts or use the wrenches to loosen the lock nuts. The present invention uses an adjustment screw to lock the piston rod travel adjuster. This small screw can locked and loosened by the use of a small hex wrench or screwdriver which is inserted into the opening on the bottom of the adjustment screw. It is much easier to use a small tool in this limited space of a race car engine.

There are no machined surfaces on the said system in which a threaded travel rod attached to the piston rod by an oval carrier plate slides through an oval shaped opening in an oval shaped guide plate attached to the cylinder. Metal objects without machined surfaces have small rough spots and irregularities on their surfaces which make it difficult to accurately measure from one surface to another. The threaded travel rod is marked with lines on its flat side indicating distance along the travel rod. The travel of the piston rod can be adjusted only between 0.050 and 0.100 inch increments. This adjustment must be done by looking at the lines marked on the travel rod and lining one line against the oval shaped guide plate attached to the cylinder, then tightening the lock nuts with a wrench. This is not very precise because of the limited space in the engine to do this and because the travel rod could move while tightening the lock nuts. Adjustment must be done by looking at the line on the travel rod against the oval shaped guide plate and adjusting the lock nuts. The present invention has all machined surfaces which will allow precise measurements from one surface to another. The piston rod travel length is adjusted by measuring the distance between the end of the cylinder and the piston rod stop plate using dial caliper or digital caliper and can be measured precisely to 0.001 inch accuracy. The adjustment is done by loosening the adjustment screw and sliding the piston rod travel adjuster in the adjustment slot to the desired position. The adjustment screw is snugged by using the fingers so it will not move while measuring the distance with a caliper. Fine adjustments can be made by loosening, slightly moving, and tightening the adjustment screw by hand. When the precise measurement is made the adjustment screw is locked tight with an hex wrench or screw driver. The distance can be quickly and accurately measured at any time by using a caliper.

The said system has an oval carrier plate attached by a nut to the piston rod. This oval carrier plate could be bent out of adjustment if it was hit by anything. The present invention does not attach the piston rod travel restricting system to the piston rod. The piston rod travel adjuster is securely attached to a mounting bar and the piston rod travel adjuster and the small adjustment screw cannot be moved if hit.

OBJECTS AND ADVANTAGES

Accordingly, there are several objects and advantages of the present invention. It is an object of the present invention to provide a system that will allow a drag race car driver to be more consistent at the starting line by reducing the number of tasks that need to be done to stage the race car and thereby allowing the driver to maintain a clear mind to concentrate on the start of the race and not on making extra movements in the race car.

Another object of the present invention is to provide a system that will eliminate the possibility of a driver not having the engine r.p.m. high when the race starts because the engine will automatically and instantly go to full throttle when it is needed.

Another object of the present invention is to provide a system that will eliminate engine stumble on the starting line by applying the throttle automatically, smoothly and when it is required to be at full throttle. Further objects and advantages of the present invention will become apparent from a consideration of the drawings and ensuing description.

Another object of the present invention is to provide a piston rod travel restricting means that is easy to adjust in the limited space of a drag race car engine using a small tool.

Another object of the present invention is to provide a piston rod travel restricting means that can be adjusted accurately and measured easily at any time.

Another object of the present invention is to provide a piston rod travel restricting means that is not subject to distortion during movement or if it is hit.

SUMMARY OF THE INVENTION

Briefly described, the present invention comprises, in a preferred embodiment thereof, a dual piston cylinder with a starting line piston rod travel restricting assembly, a down-track piston rod travel restricting assembly, and an electronic activation assembly.

The dual piston cylinder includes a starting line throttle actuation means including a piston connected to the carburetor linkage of a carburetor of an engine of a drag racing car, which is controlled by an electronic activation assembly which causes the piston rod to extend and retract to open and close the carburetor linkage, a starting line piston rod travel restricting assembly which limits the distance the piston rod can extend, and a source of compressed gas which causes the piston rod to extend from the piston/cylinder assembly.

When the mode switch is set to pro tree mode, and the driver arms the system by turning on the on/off switch and opens the throttle the electronic activation assembly turns off the source of compressed gas to the cylinder and the piston rod extends from the cylinder causing the carburetor linkage to reduce the r.p.m. of the engine allowing the driver to stage the drag race car at a preset r.p.m. using only the foot brake in the drag race car. The starting line piston rod travel restricting assembly functions to stop the extension of the piston rod from the cylinder at a preset adjustable position. When the transmission brake button is pressed the electronic activation assembly causes the source of compressed gas to be shut off and the compressed gas is vented from the cylinder into the atmosphere and the piston rod retracts into the cylinder causing the carburetor linkage to open and increase the r.p.m. of the engine. This allows the driver to stage the race car at an a low preset r.p.m. while holding the throttle pedal open and automatically leave the starting line at full throttle.

When the mode switch is set to full tree mode, and the driver arms the system by turning on the on/off switch the electronic activation assembly turns off the source of compressed gas to the cylinder and the piston rod extends from the cylinder. When the driver opens the throttle the r.p.m. cannot exceed the preset limit. This allows the driver to stage the drag race car at a preset r.p.m. using only the foot brake in the drag race car. The starting line piston rod travel restricting assembly functions to stop the extension of the piston rod from the cylinder at a preset adjustable position. After the driver has staged the car, when the transmission brake button is pressed the electronic activation assembly does not affect the source of compressed gas and the r.p.m.

stays at the preset level. When the transmission brake button is released by the driver at the start of the race it causes the source of compressed gas to be shut off and the compressed gas is vented from the cylinder into the atmosphere and the piston rod retracts into the cylinder causing the carburetor linkage to open and increase the r.p.m. of the engine. This allows the driver to stage the race car at a low preset r.p.m. while holding the throttle pedal open and automatically leave the starting line at full throttle.

The dual piston cylinder assembly also contains a down-track throttle limiting means. After the race car leaves the starting line at full throttle the throttle stop timer activates a solenoid which allows the compressed gas in the cylinder to vent out which causes the piston rod to extend from the cylinder which lengthens the distance between the throttle cable and the carburetor linkage and closes the throttle valve on the carburetor reducing the engine r.p.m. After a preselected time the throttle stop timer stimulates the solenoid and causes compressed gas to be introduced into the cylinder which causes the piston rod to retract into the cylinder which opens the throttle valve on the carburetor increasing the engine r.p.m.

LIST OF REFERENCE NUMBERS

Figure 1:
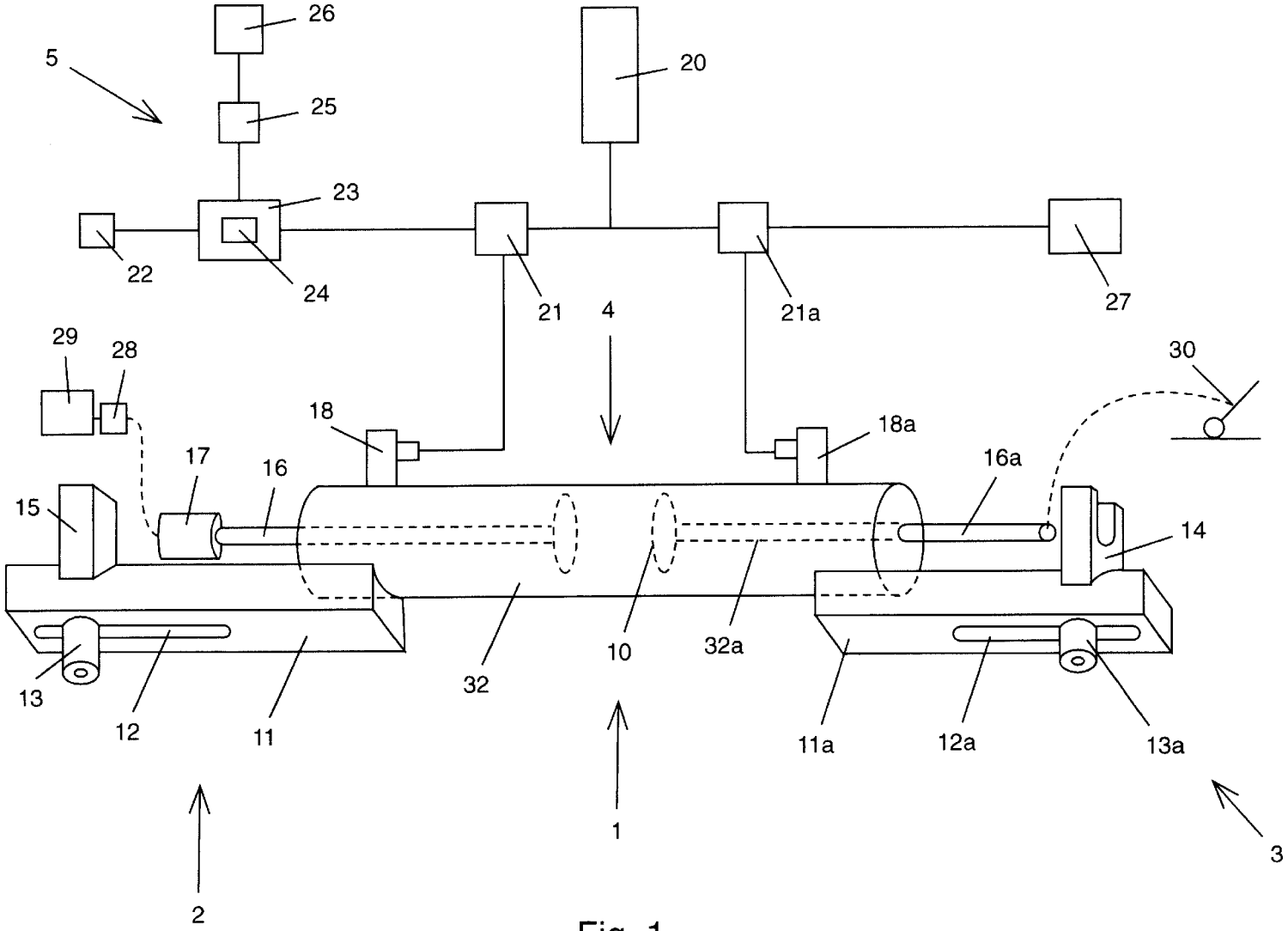
FIG. 1 is a diagrammatic view of the adjustable automatic throttle actuation controller and electronic activation assembly constructed in accordance with a preferred embodiment of the present invention.

1 adjustable starting line automatic throttle actuation controller
2 starting line piston rod travel restricting assembly
3 down-track piston rod travel restricting assembly
4 dual piston cylinder assembly
5 electronic activation assembly
10 starting line cylinder
10*a* down-track cylinder
11 mounting bar
11*a* mounting bar
12 adjustment slot
12*a* adjustment slot
13 adjustment screw
13*a* adjustment screw
14 piston rod travel adjuster with slot
15 piston rod travel adjuster
16 piston rod
16*a* piston rod
17 ball connector
18 adjustable flow control valve
18*a* adjustable flow control valve
19 connection to throttle cable
20 source of compressed gas
21 solenoid
21*a* solenoid
22 transmission brake button
23 electronic control box
24 mode switch
25 on/off switch
26 12 volt power source
27 throttle stop
28 carburetor linkage
29 carburetor
30 throttle pedal
32 piston
32*a* piston

DESCRIPTION OF THE INVENTION

Referring now in more detail to the drawings, in which like numerals represent like parts throughout the several views, FIG. 1 illustrates an adjustable automatic throttle actuation controller 1 that embodies the principles of the present invention in a preferred form. The adjustable automatic throttle actuation controller 1 comprises generally a dual piston/cylinder assembly 4, a starting line piston rod travel restricting assembly 2, a down-track piston rod travel restricting assembly 3, an electronic activation assembly 5, and a source of compressed gas 20. The carburetor linkage 28 is shown connected to the ball connector 17 and the throttle pedal 30 is connected to the piston rod 16*a*.

The source of compressed gas 20 has a control valve which is open and is connected to the solenoids 21 and 21*a*. The electronic control box 23 includes a mode switch 24 which can be set at pro tree mode or full tree mode. The on/off switch 25 is interconnected between the 12 volt power source 26 and the electronic control box 23 and enables the electronic activation assembly to be turned on or off. The transmission brake button 22 is connected to the electronic control box 23.

When the mode switch 24 is in pro tree mode depression of the transmission brake button 22 causes the electronic control box 23 to cause the solenoid 21 to shut off the flow of compressed gas to through the adjustable flow control valve 18 causing the piston rod 16 to retract into the cylinder 10. As the piston rod 16 retracts into the cylinder 10 the ball connector 17 interconnected between the piston rod 16 and the carburetor linkage 28 causes the engine to increase r.p.m. The starting line piston rod travel restricting assembly 2 includes a piston rod travel adjuster 15 which can be adjusted by allowing it to travel in the slot 12 in the mounting bar 11 and securely locked into a desired distance from the cylinder 10 by using the adjustment screw 13 and functions to stop the extension of the piston rod 16 and ball connector 17.

When the throttle stop 27 is activated it causes the solenoid 21*a* to allow compressed gas to flow through the adjustable flow control valve 18*a* and into the cylinder 10*a* causing the piston rod 16*a* to extend from the cylinder 10*a* and as the piston rod 16*a* extends from the cylinder 10*a* connection 19 interconnected between the piston rod 16*a* and the throttle pedal 30 to shorten and adjust to a preset r.p.m. even when the throttle pedal 30 is open. The piston rod travel adjuster with slot 12*a* limits the travel of the piston rod 16*a*. When the throttle stop 27 is reactivated it causes solenoid 21*a* to cut off the flow of compressed gas from the source of compressed gas 20 and to vent the compressed gas from the cylinder 10*a* to the atmosphere which causes the piston rod 16*a* to retract into the cylinder 10*a* which opens the carburetor linkage 28 which increases the r.p.m. of the engine which is controlled by the depressable throttle pedal 30.

Figure 2:
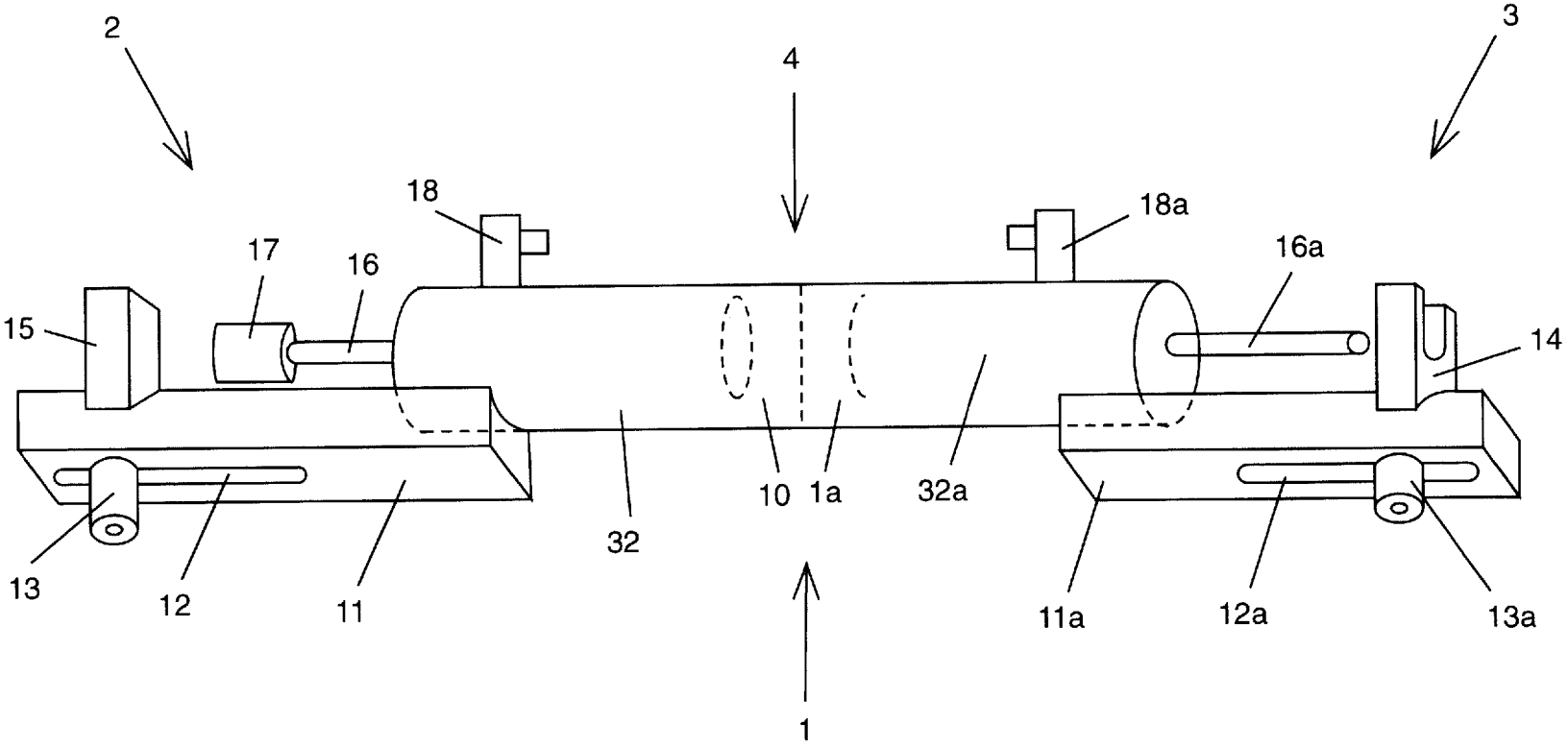
FIG. 2 is a perspective view of the adjustable automatic throttle actuation controller assembly of FIG. 1.

FIG. 2 is a perspective view of the adjustable automatic throttle actuation controller including the dual piston cylinder assembly 4 the starting line piston rod travel restricting assembly 2 and the down-track piston rod travel restricting assembly 3.

Thus, it can be seen that the adjustable automatic throttle actuation controller 1 functions as a means to automatically adjust the engine r.p.m. to a preset limit or to full throttle during the staging of a drag race car prior to the start of a race and after the start of a race. Likewise, it can be seen that the starting line piston rod travel restricting assembly 2 and the down-track piston rod travel restricting assembly 3 function as a means for accurately presetting and limiting the amount that the carburetor linkage opens the carburetor from full throttle to a preset limited r.p.m.

Making the starting line throttle actuation controller adjustable allows a racer to hold the throttle open and reduce the number of tasks that must be performed during staging while staging in a controlled manner at a lower engine r.p.m., and making the starting line throttle actuation controller automatic allows the racer to focus on the start of the race rather than be concerned about the start lights coming on too fast or doing too many tasks and allows the engine to come to full r.p.m. automatically and smoothly when it is required.

Making the down-track piston rod travel restricting assembly easy to adjust with a small tool, accurate to a thousandth of an inch, and sturdy and less subject to being knocked out of alignment provides greater control in setting the desired engine r.p.m. with throttle valve adjustments.

Although the description above contains many specificities, these should not be constructed as limiting the scope of the invention but as merely providing illustrations of some of the presently preferred embodiments of this invention. For example, the piston rod travel restricting assembly can have other shapes, such as rounded sides or bottom; the slot can be longer or wider; the adjustment screw can be a different shape or have a shape or slots so it can be tightened with a wrench, screwdriver, hex wrench, or other tool or be tightened by hand; the ball connector can be a different shape or configuration and attach to the carburetor linkage by different means.

Thus the scope of the invention should be determined by the appended claims and their legal equivalents, rather than by the examples given.

I claim:

1. A starting line throttle actuation system for a race vehicle including an engine, and throttle pedal, while the throttle pedal is fully depressed, comprising:

an electronic activation means constructed and arranged to regulate the flow of compressed gas into and out of a cylinder with a piston rod;

a piston and cylinder assembly means with a piston rod that will open and close a throttle of a vehicle to full engine r.p.m. and a preset low engine r.p.m.;

and a piston rod travel restricting means that will limit the distance of the piston attached to the carburetor linkage can extend from the cylinder and thereby limit the engine r.p.m., wherein activating the electronic activation means causes the piston rod to move the throttle to the preset low engine r.p.m. for allowing the vehicle to position at the starting line of a race, and releasing the activating means causes the vehicle to run at full engine r.p.m.

2. The starting line throttle actuation system in claim 1 wherein the piston rod travel restricting means is adjustable.

3. The starting line throttle actuation system in claim 1 wherein the electrical activation means controls the gas by means of restriction of said pressurized gas into said cylinder thereby controlling the rate of retraction of said piston rod.

4. An adjustable automatic throttle actuation controller for a racing vehicle including an engine, carburetor, and throttle-pedal the improvement therein comprising:

a dual piston cylinder assembly;

an electronic activation assembly constructed and arranged to regulate the flow of compressed gas independently into and out of one cylinder in the dual piston cylinder assembly;

a dual piston cylinder assembly means with a piston rod connected to a carburetor linkage and the other piston rod connected to the throttle cable to the throttle-pedal that will open and close the throttle to full engine r.p.m. or a preset engine r.p.m.;

two piston rod travel restricting means that will limit the distance each piston can extend from the cylinder and thereby limit the engine r.p.m., wherein one of the restricting means is used during a staging process before a race begins and the other restricting means is used after a race begins.

5. An apparatus for allowing a driver to position a drag racing vehicle using only a foot brake during a staging process of a drag racing vehicle before a drag race begins, while the driver has already fully depressed a throttle-pedal, comprising:

activation means for controlling a throttle of a vehicle between a low preselected position and a full open position while a throttle-pedal is fully depressed; and a hand actuated switch for locking the vehicle in place and opening the vehicle throttle to the full open position.

6. The apparatus for allowing a driver to position a drag racing vehicle of claim 5, wherein the activation means for controlling the vehicle throttle includes:

an on and off switch; and a cylinder having a piston which is connected to the throttle, the travel distance of the piston being preset, and the on and off switch activating the piston to the preset position.

7. The apparatus for allowing a driver to position a drag racing vehicle of claim 5, wherein the hand actuated switch further includes:

a button for controlling a vehicle brake of the vehicle, wherein pressing the button locks the vehicle brake and simultaneously causes the vehicle throttle to immediately travel to the full open position for use during a Pro tree racing mode, the vehicle brake being chosen from at least one of a wheel brake, a transmission brake and a clutch.

8. The apparatus for allowing a driver to position a drag racing vehicle of claim 5, wherein the hand actuated switch further includes:

a button for controlling a vehicle brake of the vehicle, wherein releasing the button starts a preselected delay after which only the vehicle throttle moves to the full open position for use during a Full tree racing mode, the vehicle brake being chosen from at least one of a wheel brake, a transmission brake and a clutch.

* * * * *